United States Patent [19]

Romolt

[11] 3,938,655

[45] Feb. 17, 1976

[54] REMOVABLE STIFFENER FOR SPECTACLE CASES

[75] Inventor: Abraham Romolt, North Hollywood, Calif.

[73] Assignee: Master Specialty Products, North Hollywood, Calif.

[22] Filed: Sept. 9, 1974

[21] Appl. No.: 504,132

[52] U.S. Cl. ..... 206/5; 206/5 R

[51] Int. Cl.[2] ..... A45C 11/04

[58] Field of Search ..... 150/31; 190/50; 206/5; D57/1 B, 1 C

[56] References Cited

UNITED STATES PATENTS

| | | | |
|---|---|---|---|
| 1,834,419 | 12/1931 | Pratt | 206/5 R |
| 1,842,599 | 1/1932 | Fraser | 206/5 R |
| 2,650,701 | 9/1953 | Parsell | 206/5 R |
| 2,710,685 | 6/1955 | Baratelli | 206/5 R |
| 2,805,766 | 9/1957 | Nathan | 206/5 R |
| 3,050,181 | 8/1962 | Nathan | 206/5 R |

*Primary Examiner*—Steven E. Lipman

*Attorney, Agent, or Firm*—Robert Louis Finkel

[57] ABSTRACT

A removable stiffener for slip-in spectacle cases is formed by bending a sheet of resilient metal into a U-shaped structure approximating the cross-section of the spectacle case and lined on its internal concave surface with a soft, non-abrasive material. The stiffener is manually compressed prior to insertion into the spectacle case and is retained therein by the friction developed between its external surface and the inner walls of the case, due to its restrained expansion. The insert stiffens the case and prevents damage to the eyeglasses carried therein.

5 Claims, 4 Drawing Figures

Fig. 3
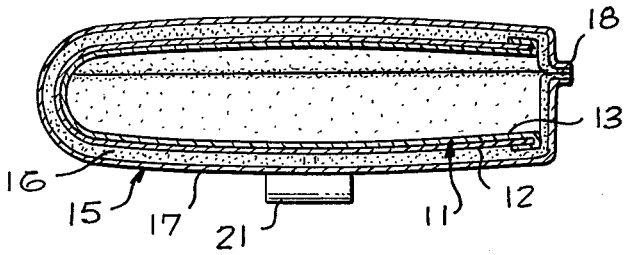
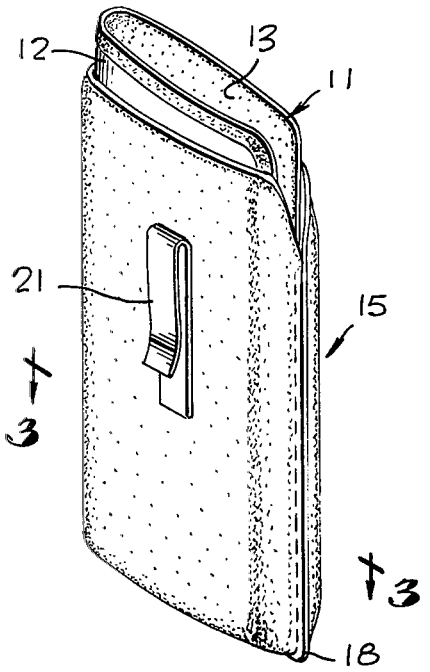
Fig. 2
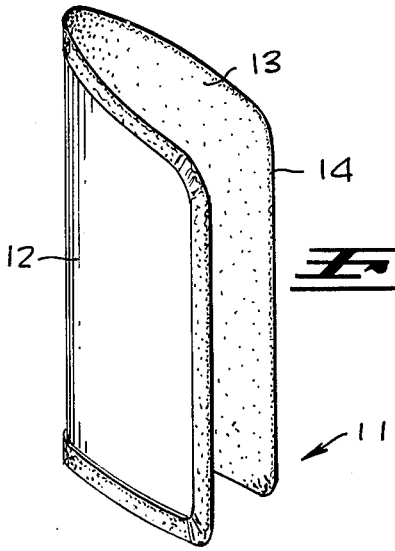
Fig. 1
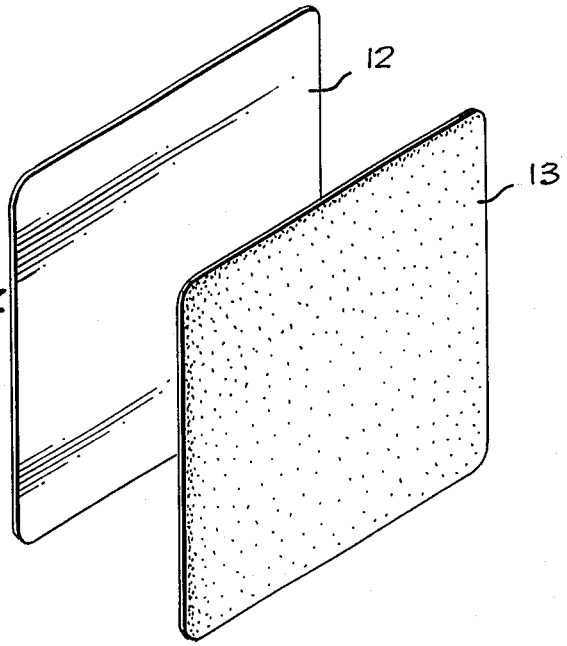
Fig. 4

REMOVABLE STIFFENER FOR SPECTACLE CASES

BACKGROUND AND SUMMARY OF THE INVENTION

This invention relates to cases for spectacles and, more particularly, to inserts for such cases which serve as protective sheets surrounding the spectacles.

The need for protective devices for conventional eyeglasses and sunglasses is evident. The lenses and frame of the average pair of spectacles are very fragile and easily damaged by abrasion and external pressure. Yet such eyeglasses may, and often must, be carried by their owners under the varied circumstances of daily life, and be readily available for use at any time. When not required, or in the way, they may have to be removed and quickly put away in order to free their wearer's hands. The pocket or pocketbook, while convenient, proves to be a generally poor, and all too frequently a downright dangerous, repository.

Many protective devices have been proposed in the prior art in recognition of the need to combine convenience of use and protection from mechanical damage and abrasion in an article which can be produced en mass for sale at a reasonable price to the user.

Rigid spectacle cases of metal and plastic materials and provided with a variety of hinged lids are known and widely used. They are inconvenient to use, generally requiring two hands for the removal and insertion of a pair of spectacles, expensive to construct, and easily damaged.

The most commonly encountered spectacle case of the recent prior art, the slip-in soft-walled sheath, is simple to use and economical to manufacture, but provides poor protection against damage.

Attempts have been made, notably in U.S. Pat. No. 2,758,707 issued to Baratelli in 1954, to provide slip-in spectacle cases with a metallic stiffener. Due to their relative high manufacturing cost, such cases have not attained any significant public acceptance.

It is, therefore, the primary object of the subject invention to teach the construction and use of an easily, massproduced, inexpensive, durable stiffening sheath which is readily insertable into a slip-in spectacle case to provide protection for its contents against mechanical damage and abrasion.

The subject invention provides for a protective liner, or stiffener for slip-in spectacle cases, comprising a thin resilient metal sheath with a soft facing cemented thereto. The metal sheath is a generally U-shaped structure, symmetrical about a plane passing through the base of the U, whose cross-section corresponds substantially to the cross-section of a slip-in spectacle case of conventional construction.

The stiffener is formed with its legs spaced some distance apart so that they must be forced together for insertion into the spectacle case. The natural resilience of the structure insures frictional engagement of the external surface of the stiffener with the internal surface of the case and prevents the stiffener from accidentally slipping out of the case. It is withdrawn by forcing the legs together to release their frictional grip on the inner wall of the case.

The stiffener may be constructed of any of a variety of convenient resilient sheet materials. However, consideration of strength, weight, resilience, workability, resistance to corrosion, cost and other factors suggests alloys of aluminum as prefered materials. Undoubtedly non-metallic, e.g., plastic materials in thin, flexible resilient sheets or suitably molded in the U-shape form described could serve as well.

The function of the lining cemented to the inside surface of the stiffener is to protect the optical surfaces of the spectacles from abrasion. A thin, soft flexible sheet material with the texture and frictional qualities of felt or velvet is desirable for this use. The lining is preferably applied to the inner face of the stiffener by means of glue or cement and is carried over the exposed edges to provide additional protection.

The stiffener is readily inserted into conventional slip-in spectacle cases and does not in any way alter their function, utility, or convenience. It will be apparent that the stiffener may be inserted at the time the glass case is manufactured and dispensed in combination with the case, or it may be dispensed separately for use with an existing case or to be transferred from case to case.

The advantage of this feature is in the flexibility and economy it affords the user. Most wearers of spectacles own several pairs and therefore have more than one spectacle case. A single stiffener may be used in all of these whenever its added protection is desired. Furthermore, if a spectacle case wears out, the stiffener may be removed and inserted in the replacement case.

Other details of construction and objects of the invention will become apparent from the following detailed description of the prefered embodiment illustrated in the accompanying drawing in which: BRIEF DESCRIPTION OF THE DRAWINGS FIG. 1 is a perspective view of a stiffener for a slip-in spectacle case in accordance with the subject invention;

FIG. 2 is a perspective view of a spectacle case having an integrally formed clip, showing a stiffener similar to that of FIG. 1 being inserted therein;

FIG. 3 is a sectional view of the case and stiffener illustrated in FIG. 2, taken along the line 3—3 of FIG. 2;

FIG. 4 is an exploded perspective view of the elements of the stiffener.

DESCRIPTION OF THE PREFERRED EMBODIMENTS

Referring to FIGS. 1, 2 and 3, the stiffener 11 is constructed from a metal sheet 12 bent into a symmetrical U-shaped structure and covered on its concave surface with a lining 13 of thin velvet, nylon tricot, or similar soft fabric glued or cemented in place with any suitable adhesive material. For illustrative purposes, 0.016–0.20 inch-thick sheet aluminum alloy 6061, heat treated to T-6 temper has been used for this purpose with excellent results.

The edges 14 of the stiffener 11 are spaced apart, preferably a distance equal to or greater than the width of the bay formed at the base of the U, so that upon insertion into a spectacle case 15 they may be forced together without exceeding the elastic range of the base. The resilience of the stiffener 11 is utilized to create a semi-permanent structure when it is inserted into a typical spectacle case 15.

The stiffener 11 is shown in place in the spectacle case 15 in the sectional view of FIG. 3. The slip-in spectacle case 15 is a composit structure formed with a soft sheath 16, conventionally of a foamed plastic or similar material having a flexible textured exterior coating 17, conventionally of simulated leather, vinyl sheeting, or the like.

The case 15 is customarily made by folding a subtantially rectangular piece of the sheathing material 16 in half and sewing or cementing the sides and lower edge together along the seam 18. An optional clip 21 may be attached to one side of the case 15, preferably by means such as flush rivet 22, which permits the clip 21 to be rotated.

The stiffener 11 is so oriented with respect to the case 15 that the base of its fold enters the case along the edge opposite the seam 18, while the open edges 14 adjoin the seam 18. The resilience of the stiffener tends to spread the edges 14 outwardly against the inner walls of the sheath 16. The elasticity of the sheath 16 urges the edges 14 of the stiffener 12 together and into motion-restraining contact with the spectacles when they are inserted into the case 15.

Rotatable clip 21 permits the user to slip the case 15 into a pocket, or to attach it to his belt, with equal ease.

The case 15 does not, by itself, provide adequate protection against mechanical damage to its fragile contents. The very softness and compliance which prevent the scratching of the optical elements of spectacles militate against the stiffness necessary to provide protection against external blows or crushing loads.

The insertion of stiffener 12 into the case 15 does provide such protection by partly absorbing and partly distributing such external loads. The lining 13 of the stiffener 12 insures that no hard surface comes into contact with the lenses and prevents abrasive damage.

The liner 13 is carried over the edges 14 around the periphery of the stiffener 12 to provide additional protection. In some instances it may be prefered that the stiffener be made from a sheet of resilient material, such as aluminum or steel, pre-coated with a layer of yielding plastic in place of liner 13. This coating may be extended around the edges 14 to protect both the spectacles and the sheath 16 from any irregularities or roughness which might otherwise cause excessive wear or damage.

This perspective view of FIG. 4 shows blanks 12 and 13 of sheet metal and lining material, respectively, prior to their being joined and formed into the removeable stiffener of FIGS. 1–3.

The lining blank 13 is cut somewhat larger than the metal blank 12 to allow for folding over the edges of the latter. Metal blank 12 is cut with rounded corners and deburred to eliminate any sharp edges.

The dimensions and configurations of most existing glass cases are sufficiently standardized so that stiffeners 11 in a relatively few basic sizes and shapes would fit all but a few of them. If desired, of course, a stiffener could be specifically matched to any given case.

It is also possible to utilize the stiffener of the invention to provide glass holders similar to the slip-in type case. By way of example, a pocket or pouch formed in clothing or an accessory may quickly be converted into a convenient spectacle carrier by the insertion of a stiffener such as that described here.

Thus the stiffener of the invention as shown and disclosed provides a simple and economical means for protecting eyeglasses while stored and transported. Its shape and mechanical construction may be varied to adapt it to particular uses and circumstances. Such changes and alternative uses will become apparent to one skilled in the art upon exposure to the teachings of the invention, whose scope is limited only by the appended claims.

I claim as my invention:

1. A two-piece spectacle case comprising in combination:

an elongated tubular outer sheath of flexible material having one end thereof open to receive a pair of spectacles inserted axially into said sheath coaxially therewith; and an elongated longitudinally rigid stiffener removably disposed within said sheath and defining a spectacle-receiving channel of generally U-shaped cross-section having opposed, spaced, resiliently connected front and rear walls, said stiffener being inserted slidingly into said sheath axially through said open end with the walls of said stiffener spaced apart a certain distance and exerting an outwardly directed force against said sheath to maintain said sheath in substantial conformity with the cross-sectional shape of said spectacles.

2. A two-piece spectacle case as described in claim 1, wherein said stiffener comprises a sheet of resilient material permanently formed with said generally U-shaped cross-section.

3. A two-piece spectacle case as described in claim 2, wherein:

said sheath comprises spaced front and rear panels, said panels being joined along all but a portion of their adjacent edges to define an elongated tube having one end thereof open, the front and rear walls of said channel conform generally to said front and rear panels, respectively; and said stiffener is formed with said front and rear walls normally spaced apart more widely than said front and rear panels.

4. A two-piece spectacle case as described in claim 3, wherein said stiffener engages said spectacles in frictional contact therewith.

5. A two-piece spectacle case as described in claim 4, wherein said stiffener is lined with a yielding nonabrasive material, whereby spectacles in said case are protected from abrasive contact with said front and rear walls.

* * * * *